US005163589A

United States Patent [19]

Biehl

[11] Patent Number: 5,163,589

[45] Date of Patent: Nov. 17, 1992

[54] CAP PRESS

[76] Inventor: Dave L. Biehl, Rte. 2, Box 215, Hastings, Nebr. 68901

[21] Appl. No.: 747,798

[22] Filed: Aug. 16, 1991

[51] Int. Cl.[5] ..... A42C 1/00

[52] U.S. Cl. ..... 223/24; 223/25

[58] Field of Search ..... 223/24, 25

[56] References Cited

U.S. PATENT DOCUMENTS 2,812,887 11/1957 Palinkas ..... 223/24
4,607,769 8/1986 DeLisle ..... 223/25
4,708,271 11/1987 Grommes ..... 223/25
4,739,909 4/1988 Bury ..... 223/25
5,074,410 12/1991 Fries ..... 223/24

*Primary Examiner*—Werner H. Schroeder
*Assistant Examiner*—Diana L. Biefeld
*Attorney, Agent, or Firm*—Zarley, McKee, Thomte, Voorhees & Sease

[57] ABSTRACT

A cap press includes a generally cylindrical base portion for stretching the body of a cap, and a visor clamp with a pair of jaws operably connected together to press the cap visor into a predetermined shape.

7 Claims, 2 Drawing Sheets

CAP PRESS

TECHNICAL FIELD

The present invention relates generally to baseball caps and the like, and more particularly to an improved apparatus which forms and shapes a laundered cap.

BACKGROUND OF THE INVENTION

Baseball caps, and similar hats having a generally domed-shaped body with a fabric covered visor are notorious for becoming quickly and easily soiled, wrinkled and out of shape. To date, it has been difficult, if not impossible, to clean the caps, since the washed cap will not retain its original form and appearance.

It is therefore a general object of the present invention to provide an apparatus for forming and shaping a cap.

Another object is to provide a cap shaping apparatus which will rejuvenate caps which have been wrinkled by the process of washing.

A further object of the present invention is to provide an apparatus for straightening and shaping the visor of a cap.

Yet another object is to provide an apparatus for shaping a cap which is simple to use and economic to manufacture.

These and other objects will be apparent to those skilled in the art.

SUMMARY OF THE INVENTION

The cap press of the present invention includes a generally cylindrical base portion for stretching the body of a cap, and a visor clamp with a pair of jaws operably connected together to press the cap visor into a predetermined shaped.

DESCRIPTION OF THE PREFERRED EMBODIMENT

Figure 1:
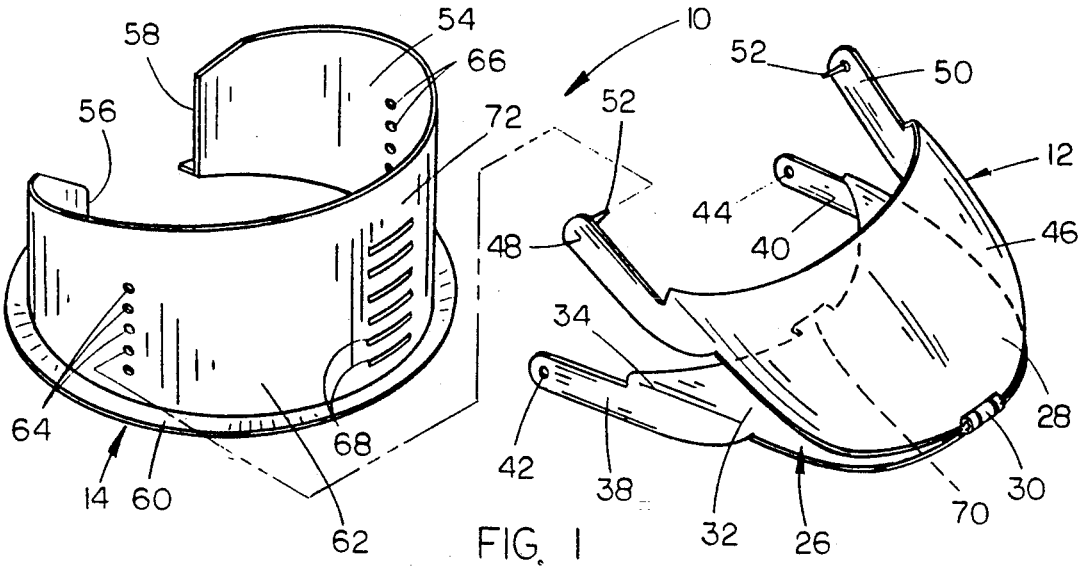
FIG. 1 is an exploded perspective view of the cap shaping apparatus of the present invention.

Referring now to the drawings, in which similar or corresponding parts are identified with the same reference numeral, and particularly to FIG. 1, the cap press of the present invention is designated generally at 10 and includes a visor clamp 12 which is selectively connectable to a base 14.

Figure 4:
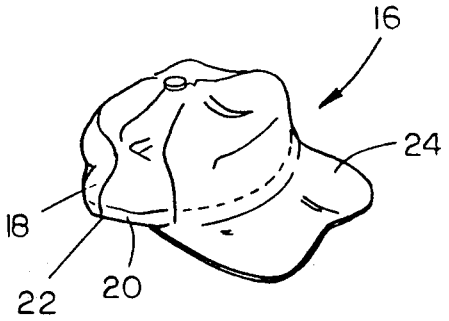
FIG. 4 is a perspective view of a washed and wrinkled cap prior to shaping.

FIG. 4 illustrates a cap 16 which has been laundered and left wrinkled and out of shape. Cap 16 includes a generally domed-shaped cap body 18 having a support strap 20 attached along the lower generally circular edge 22 in a conventional fashion. A visor 24 extends forwardly from lower edge 22 of body 18, and is conventionally a fabric covered structure.

The visor clamp 12 of cap press 10 includes a lower jaw 26 and an upper jaw 28 which are pivotally connected at a hinge 30 along the forward edges of upper and lower jaws 28 and 26. Lower jaw 26 includes a generally crescent-shaped plate portion 32 which is slightly upwardly arched between its left and right sides 34 and 36 so as to be formed in a general shape of a cap visor. A pair of straps 38 and 40 extend rearwardly from left and right edges 34 and 36 respectively, and have apertures 42 and 44 in their rearward ends, for purpose to be described in more detail herein below.

Upper jaw 28 also includes a crescent-shaped plate 46 curved and shaped the same as lower plate 32. Upper plate 46 has a pair of legs 48 and 50 extending rearwardly from its left and right edges of a shape and length corresponding to straps 38 and 40. Legs 48 and 50 are attached to plate 46 a distance apart slightly greater than straps 38 and 40 such that legs 48 and 50 will be juxtaposed immediately adjacent and parallel to straps 38 and 40 upon pivoting of plate 46 downward adjacent lower plate 32.

A pair of pins 52 project inwardly from legs 48 and 50 and will be received through apertures 42 and 44 when legs 48 and 50 are juxtaposed adjacent straps 38 and 40. Preferably, legs 48 and 50 are of a resilient material which will permit slight bending such that legs 48 and 50 may be bent outwardly to permit pins 52 to be received through apertures 42 and 44.

Base 14 includes a vertically oriented rigid cylindrical tube 54 which is open along a rearward vertical portion to form free vertical edges 56 and 58. A flange 60 projects outwardly along the lower edge 62 of tube 54. A series of vertically aligned and spaced apart apertures 64 are formed along one side of tube 54 and are adapted to receive pin 52 on leg 48 therethrough. A series of similar apertures 66 are formed in tube 54 diametric to apertures 64 to receive pin 52 on leg 50. A series of vertically aligned and vertically spaced apart horizontal slots 68 are formed in the forward portion of tube 54 and are designed to receive a tooth 70 formed and centered on the rearward edge of lower plate 32 of visor clamp 12. Preferably, the height of tube 54 is greater at the forward portion 72 than at the rearward edges 56 and 58, as shown in FIGS. 1 and 3.

Figure 5:
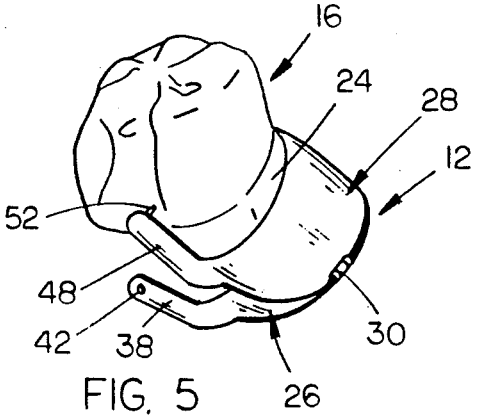
FIG. 5 is a pictorial view illustrating the first step in utilizing the invention.

In operation, a dirty crumpled cap is first laundered and then sprayed with a spray starch, with a resulting appearance similar to FIG. 4. The visor 24 is placed on lower jaw 26 of visor clamp 12, and upper jaw 28 is then pivoted at hinge 30 so as to clamp visor 24 between jaws 26 and 28, as shown in FIG. 5. Legs 48 and 50 are bent slightly outwardly so as to insert pins 52 into apertures 42 and 44 in straps 38 and 40, thereby locking visor clamp 12 onto visor 24 of cap 16.

Figure 3:
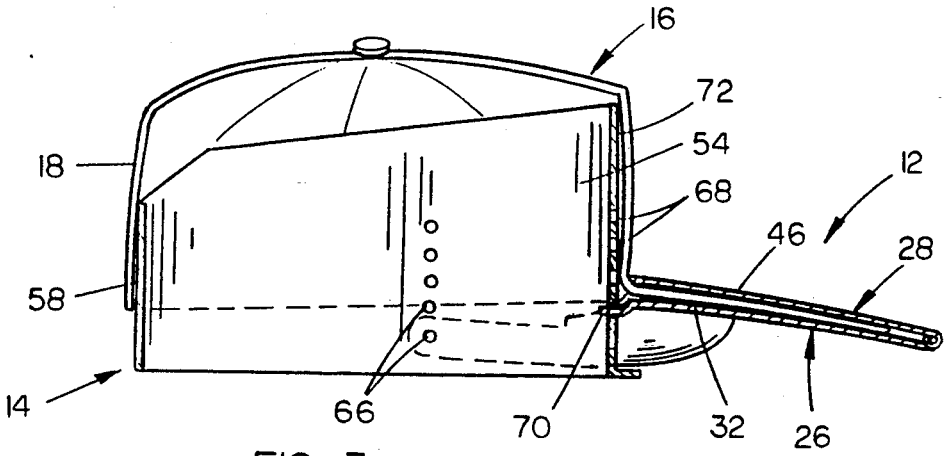
FIG. 3 is a vertical sectional view taken through FIG. 2.
Figure 6:
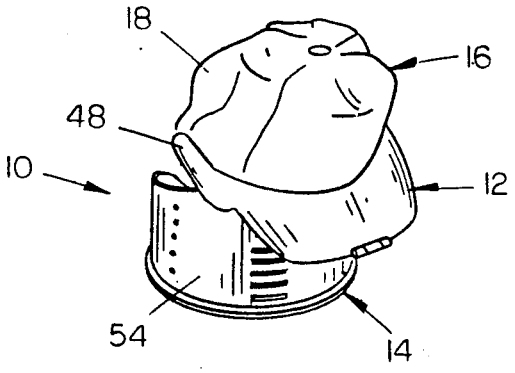
FIG. 6 is a pictorial view illustrating a second step in utilizing the invention.

Referring now to FIGS. 3 and 6, visor clamp 12 is connected to base 14 by inserting tooth 70 into one of slots 68 on tube 54. The body 18 of cap 16 is then stretched around tube 54 and legs 48 and 50 are again bent slightly outwardly such that pins 52 (see FIGS. 1 and 5) are inserted in one of apertures 64 and 66 on base tube 54. Preferably, visor clamp 12 is forced downwardly to stretch body 18 of cap 16 so that pins 52 are inserted in the lowest apertures permitted along tube 54.

Figure 2:
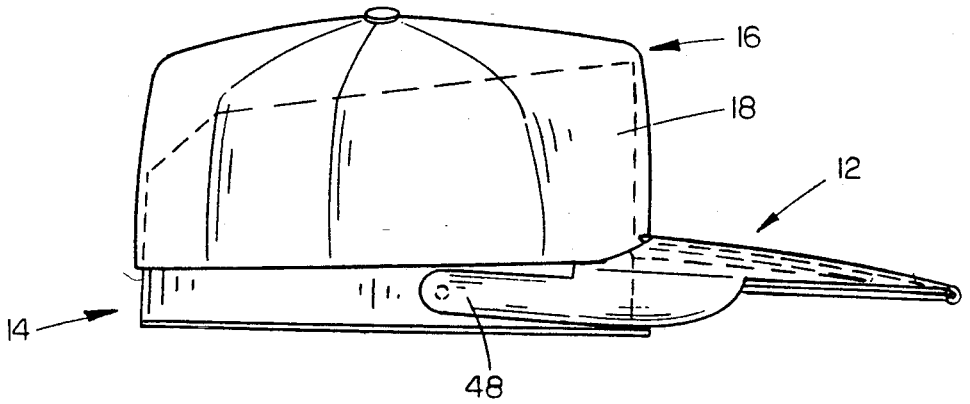
FIG. 2 is a side elevational view of the invention with a cap installed thereon.
Figure 7:
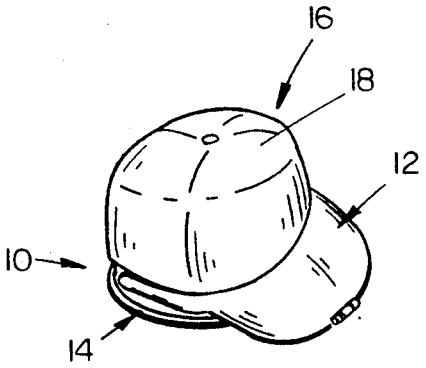
FIG. 7 is a pictorial view illustrating a third step in utilizing the invention.

Once visor clamp 12 is installed on base 14, it will appear as shown in FIGS. 2, 3 and 7. The taller vertical surface of tube 54 at front portion 72 (as shown in FIG. 3) will assist in pressing the forward portion of cap 16, upon which various graphics are typically applied. Because tube 54 is not a complete cylinder, edges 56 and 58 may be squeezed towards one another to assist in attaching body 18 of cap 16 onto tube 54. Once released, edges and 58 will return to their original position, stretching cap body 18.

Figure 8:
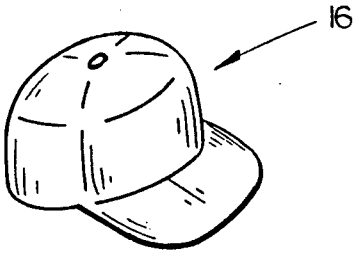
FIG. 8 is a pictorial view of the cap of FIG. 4 after being shaped utilizing the method and apparatus of the invention.

Cap 16 is removed from cap press 10 by reversing the previously described steps. In this way, a clean, pressed cap is shaped by cap press 10, as shown in FIG. 8.

Whereas the invention has been shown and described in connection with the preferred embodiment thereof, it will be understood that many modifications, substitutions and additions may be made which are within the intended broad scope of the appended claims. For example, upper jaw 28 may be pivotally connected to lower jaw 26 with structure other than the hinge 30 shown and described. There has therefore been shown and described an improved cap press which accomplishes at least all of the above stated objects.

I claim:

1. A cap press for shaping a cap of the type having a generally domed-shaped body and a forwardly projecting visor, comprising:

a visor clamp having upper and lower jaws operably connected together to press a cap visor into a predetermined shape;

said visor clamp lower jaw including a lower generally crescent-shaped plate having left and right ends and forward and rearward curved portions extending between said ends;

said upper jaw including an upper generally crescent-shaped plate having left and right ends and forward and rearward curved portions extending between said ends;

the ends of said crescent-shaped plates being oriented rearwardly, and the forward curve portions of said upper and lower plates being pivotally connected such that the upper and lower plates are pivotable between a clamped position juxtaposed together and an open position pivoted apart;

a base portion including a generally cylindrical tubular portion for stretching a body portion of a cap, adapted for connection to said visor clamp; and means for connecting said visor clamp to said base portion.

2. The cap press of claim 1, further comprising means for selectively locking said plates in the clamped position.

3. The cap press of claim 2, wherein said selective locking means includes:

a pair of left and right straps extending rearwardly from the left and right ends of said lower plate, each said strap having an aperture therethrough;

a pair of left and right legs extending rearwardly from the left and right ends of said upper plate, each said leg having a pin projecting inwardly therefrom towards one another; and said apertures adapted to receive said pins therethrough when said plates are in a clamped position.

4. The cap press of claim 3, wherein said legs are formed of a rigid, resilient material which permits the legs to be biased outwardly in order to journal said pins through said apertures, and which has memory to return the legs to their original positions after said outward biasing.

5. The cap press of claim 3, wherein said means for connecting the visor clamp to the base portion includes at least one pair of diametric apertures formed in sides of said tube adapted to receive said pins;

tooth means on said visor clamp and projecting rearwardly therefrom; and at least one slot formed in said base tube adapted to receive said tooth means.

6. The cap press of claim 5, wherein said at least one slot is formed in a forward portion of said tube, and wherein said tube has a height which reduces rearwardly from the forward portion.

7. The cap press of claim 1, wherein said plates are curved from side to side at a radius corresponding with the curve of a conventional visor.

* * * * *